US009259049B2

(12) United States Patent
Adami et al.

(10) Patent No.: US 9,259,049 B2
(45) Date of Patent: Feb. 16, 2016

(54) ULTRALIGHTWEIGHT ADAPTIVE HEEL MEMBER

(71) Applicant: NIKE, Inc., Beaverton, OR (US)

(72) Inventors: Giovanni Adami, Montebelluna (IT); Renato Michielon, Montebelluna (IT); Tetsuya T. Minami, Portland, OR (US); Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 482 days.

(21) Appl. No.: 13/746,921

(22) Filed: Jan. 22, 2013

(65) Prior Publication Data

US 2014/0202044 A1 Jul. 24, 2014

(51) Int. Cl.

| | |
|---|---|
| ***A43B 7/20*** | (2006.01) |
| ***A43B 5/02*** | (2006.01) |
| ***A43B 7/14*** | (2006.01) |
| ***A43B 7/19*** | (2006.01) |
| ***A43B 7/24*** | (2006.01) |
| ***A43B 23/08*** | (2006.01) |
| ***A43B 23/17*** | (2006.01) |

(52) U.S. Cl.

CPC . *A43B 5/02* (2013.01); *A43B 7/141* (2013.01); *A43B 7/19* (2013.01); *A43B 7/20* (2013.01); *A43B 7/24* (2013.01); *A43B 23/088* (2013.01); *A43B 23/17* (2013.01)

(58) Field of Classification Search

CPC ..... A43B 5/02; A43B 7/24; A43B 7/16; A43B 7/17; A43B 7/20; A43B 23/088; A43B 23/086

USPC ..... 36/68, 69, 89, 92, 76 HH

See application file for complete search history.

(56) References Cited

U.S. PATENT DOCUMENTS

| | | | | | |
|---|---|---|---|---|---|
| 124,094 | A | * | 2/1872 | Spaulding | 36/68 |
| 325,280 | A | | 9/1885 | Smadbeck et al. | |
| 332,727 | A | | 12/1885 | McEwen | |
| 332,728 | A | | 12/1885 | McEwen | |
| 522,371 | A | | 7/1894 | Horn et al. | |
| 545,006 | A | * | 8/1895 | Baird | 36/173 |
| 996,914 | A | * | 7/1911 | Elson | 36/68 |
| 1,090,106 | A | | 3/1914 | Montine | |
| 2,086,999 | A | * | 7/1937 | Hack et al. | 36/180 |
| 2,444,865 | A | | 7/1948 | Warrington | |
| 2,661,549 | A | | 12/1953 | Lindner et al. | |
| 2,821,032 | A | | 1/1958 | Helfet | |
| 2,867,920 | A | | 1/1959 | Dube | |

(Continued)

FOREIGN PATENT DOCUMENTS

| | | | |
|---|---|---|---|
| EP | 0 948 910 | A2 | 10/1999 |
| WO | 02/078478 | A1 | 10/2002 |

OTHER PUBLICATIONS

International Search Report and Written Opinion mailed Jul. 2, 2014 in PCT/US2014/012418.

(Continued)

*Primary Examiner* — Ted Kavanaugh

(74) *Attorney, Agent, or Firm* — Plumsea Law Group, LLC

(57) ABSTRACT

A heel member includes a base portion, a medial portion and a lateral portion. The lateral portion is a wall-like portion including a plurality of windows. The medial portion comprises a plurality of projecting portions that extend upwardly from the base portion. The medial portion may be taller than the lateral portion. The medial portion may be more flexible than the lateral portion.

20 Claims, 7 Drawing Sheets

(56) References Cited

U.S. PATENT DOCUMENTS

| | | | | |
|---|---|---|---|---|
| D192,208 | S | 2/1962 | Bradley et al. | |
| D192,784 | S | 5/1962 | Bradley et al. | |
| 4,484,397 | A | 11/1984 | Curley, Jr. | |
| 4,486,964 | A | 12/1984 | Rudy | |
| 4,506,460 | A * | 3/1985 | Rudy | 36/28 |
| 4,625,435 | A | 12/1986 | Ueda | |
| 4,638,576 | A | 1/1987 | Parracho et al. | |
| 4,821,430 | A | 4/1989 | Flemming et al. | |
| 5,106,445 | A | 4/1992 | Fukuoka | |
| 5,152,082 | A | 10/1992 | Culpepper | |
| 5,185,943 | A * | 2/1993 | Tong et al. | 36/28 |
| 5,218,773 | A | 6/1993 | Beekman | |
| 5,317,820 | A | 6/1994 | Bell et al. | |
| 5,819,440 | A | 10/1998 | Okajima | |
| D408,120 | S | 4/1999 | Fair | |
| 5,896,683 | A | 4/1999 | Foxen et al. | |
| 6,076,286 | A | 6/2000 | Donnadieu | |
| 6,497,058 | B2 | 12/2002 | Dietrich et al. | |
| 6,662,474 | B2 * | 12/2003 | Tomat | 36/69 |
| 7,086,179 | B2 | 8/2006 | Dojan et al. | |
| 7,141,131 | B2 | 11/2006 | Foxen et al. | |
| 7,401,420 | B2 | 7/2008 | Dojan et al. | |
| 7,555,848 | B2 | 7/2009 | Aveni et al. | |
| 7,556,846 | B2 | 7/2009 | Dojan et al. | |
| 7,562,469 | B2 | 7/2009 | Dojan | |
| 7,587,841 | B2 | 9/2009 | Culpepper | |
| 7,665,230 | B2 | 2/2010 | Dojan et al. | |
| 7,676,955 | B2 | 3/2010 | Dojan et al. | |
| 2014/0059883 | A1 * | 3/2014 | Adeagbo et al. | 36/28 |

OTHER PUBLICATIONS

International Preliminary Report on Patentability and Written Opinion of the International Searching Authority issued Aug. 6, 2015 in International Patent Application No. PCT/US2014/012418.

* cited by examiner

ULTRALIGHTWEIGHT ADAPTIVE HEEL MEMBER

BACKGROUND

The present embodiments relate generally to articles of footwear, and in particular to an adaptive heel member for an article of footwear.

Articles of footwear generally include two primary elements: an upper and a sole. The upper may be formed from a variety of materials that are stitched or adhesively bonded together to form a void within the footwear for comfortably and securely receiving a foot. The sole is secured to a lower portion of the upper and is generally positioned between the foot and the ground. In many articles of footwear, including athletic footwear styles, the sole often incorporates an insole, a midsole, and an outsole.

Some articles include heel members that help to provide extra support at the heel of the foot. Heel members can be integrated into an upper and/or attached to a sole.

SUMMARY

In one aspect, a heel member includes a base portion, a medial portion extending from the base portion and a lateral portion extending from the base portion. The medial portion includes a plurality of projecting portions. The medial portion is higher than the lateral portion along a majority of the length of the heel member.

In another aspect, a heel member includes a base portion, a medial portion extending from the base portion and a lateral portion extending from the base portion. The medial portion includes a plurality of projecting portions. The lateral portion includes a continuous top edge that extends along the length of the lateral portion and the lateral portion includes at least one window.

In another aspect, a heel member includes a base portion, a medial portion extending from the base portion and a lateral portion extending from the base portion. The medial portion includes a plurality of projecting portion and the lateral portion is substantially more rigid than the medial portion.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
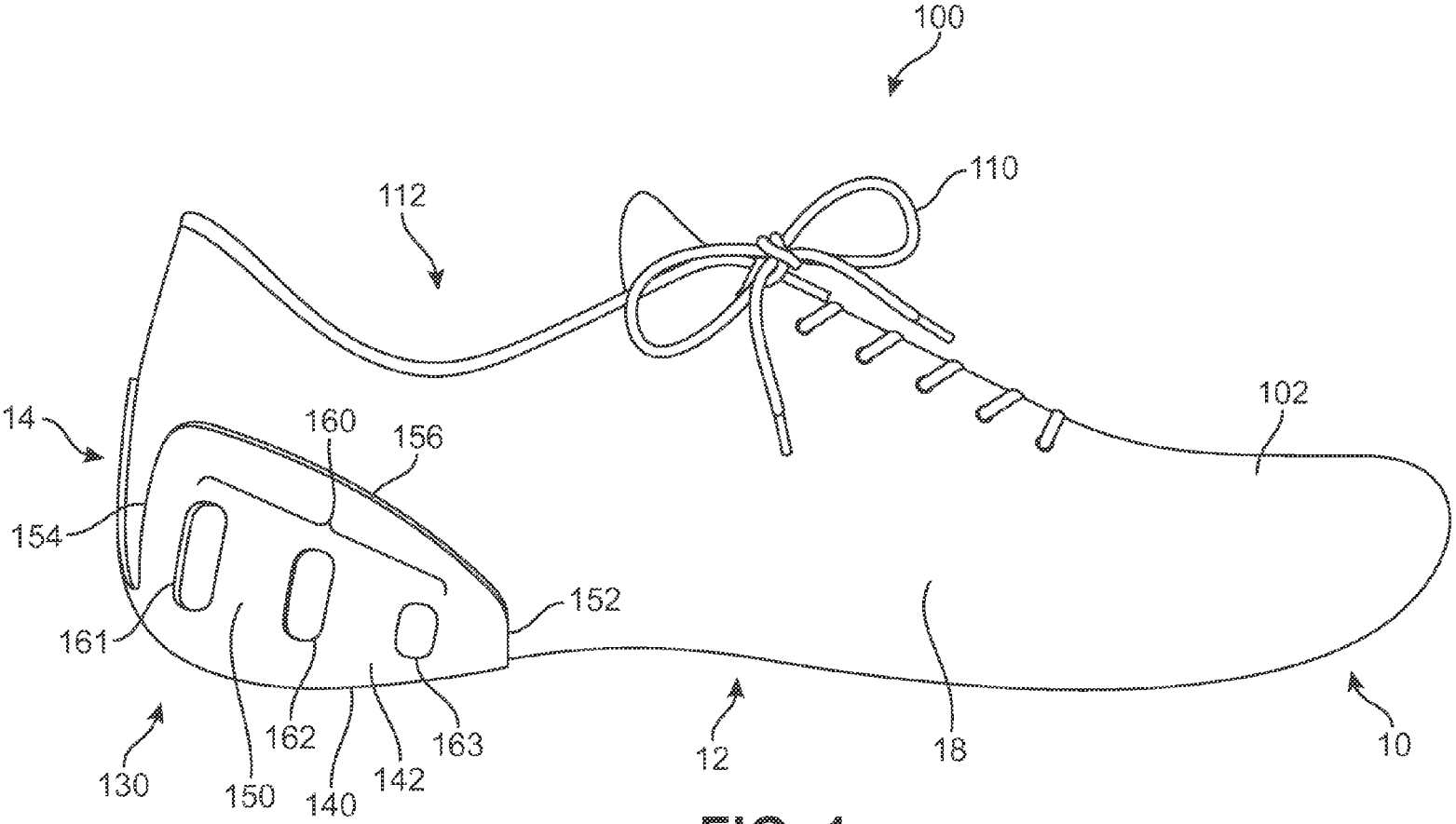
FIG. 1 is a schematic side view of an embodiment of some components of an article of footwear.

FIG. 1 is a schematic side view of an embodiment of some components of an article of footwear 100. In particular, upper 102 of article of footwear 100 is shown along with a heel member 130. For purposes of illustration, article of footwear 100 is shown without any kind of sole structure. However, it will be understood that other embodiments may include a sole structure. Sole structures may be used to attenuate ground reaction forces when compressed between the foot and the ground during walking, running or other ambulatory activities. In different embodiments, a sole structure may include different components. For example, a sole structure may include an outsole, a midsole, and/or an insole. In some cases, one or more of these components may be optional.

For clarity, the following detailed description discusses an exemplary embodiment, in the form of a sports shoe, but it should be noted that the present embodiments could take the form of any article of footwear including, but not limited to: hiking boots, soccer shoes, football shoes, sneakers, rugby shoes, basketball shoes, baseball shoes as well as other kinds of shoes. In the embodiments shown in the figures, article of footwear 100, also referred to simply as article 100, is intended to be used with a right foot; however, it should be understood that the following discussion may equally apply to a mirror image of article of footwear 100 that is intended for use with a left foot.

For purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 18 and medial side 16 (see FIG. 3). In particular, lateral side 18 and medial side 16 may be opposing sides of article 100. Furthermore, both lateral side 18 and medial side 16 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 18 and medial side 16 are intended to represent generally two sides of an article, rather than precisely demarcating article 100 into two halves.

For consistency and convenience, directional adjectives are employed throughout this detailed description corresponding to the illustrated embodiments. The term "longitudinal" as used throughout this detailed description and in the claims refers to a direction extending a length of a component, such as upper 102 or heel member 130. Also, the term "lateral" as used throughout this detailed description and in the claims refers to a direction extending a width of a component. In other words, the lateral direction may extend between a medial side and a lateral side of a component. Furthermore, the term "vertical" as used throughout this detailed description and in the claims refers to a direction generally perpendicular to a lateral and longitudinal directions. For example, in cases where article 100 is planted flat on a ground surface, the vertical direction may extend from the ground surface upward. It will be understood that each of these directional adjectives may be applied to individual components of an article, such as an upper and/or a heel member as well as to sub-components of an upper or heel component.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Upper 102 can include provisions for fastening article 100 to a foot. For example, upper 102 may include fastening system 110. In some cases, fastening system 110 comprises a shoe lace that can be used to close opening 112, which is configured to receive a foot. However, it will be understood that the type of fastening system could vary in different embodiments and may be selected according to factors including ease of use and comfort.

Figure 2:
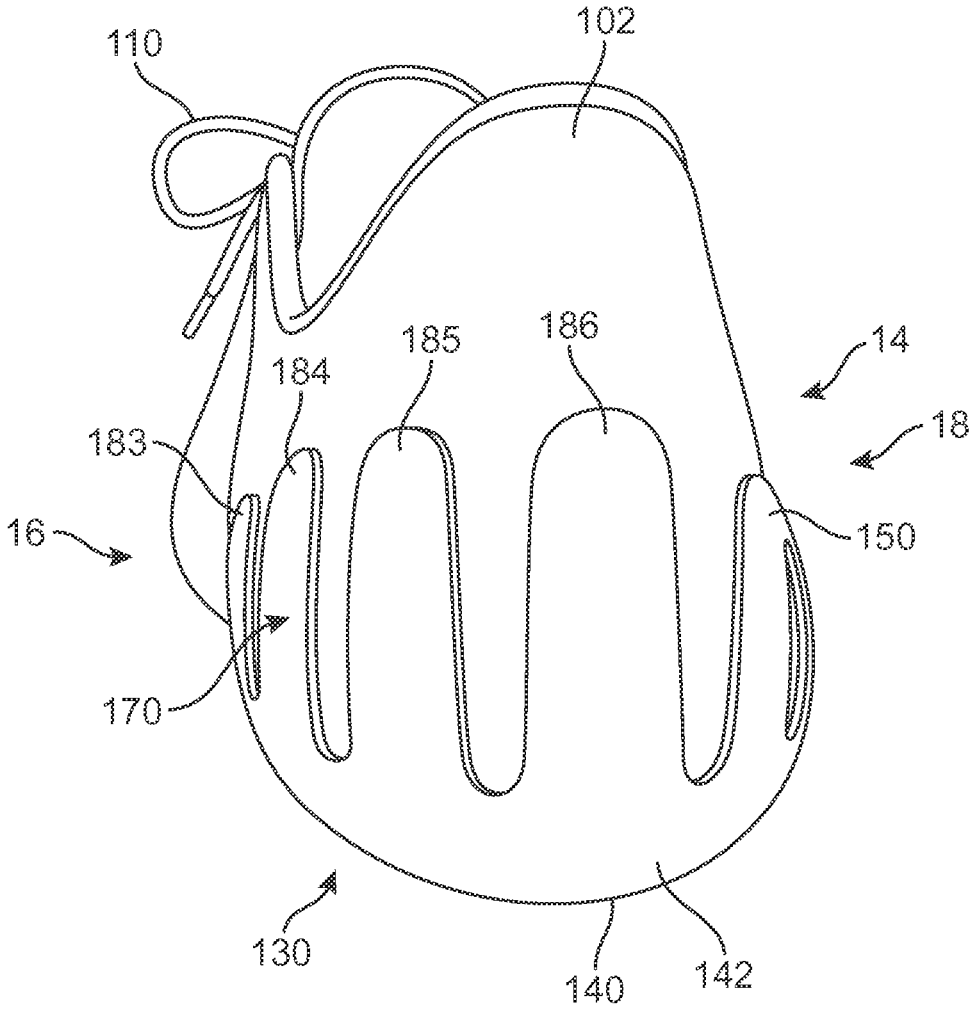
FIG. 2 is a schematic rear view of an embodiment of some components of an article of footwear.
Figure 3:
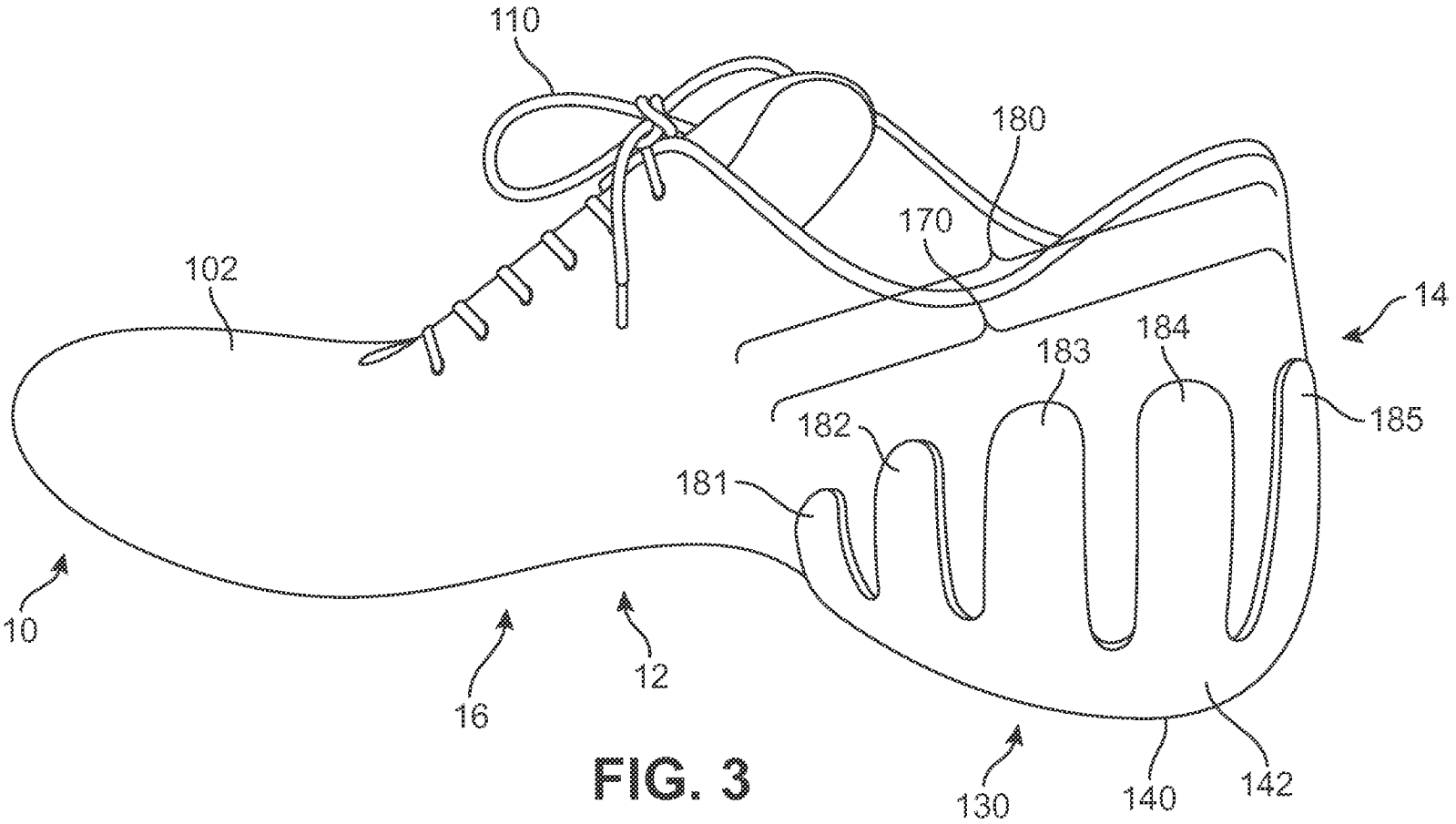
FIG. 3 is a schematic rear isometric view of an embodiment of some components of an article of footwear.

Referring now to FIGS. 1 through 3, upper 102 may include provisions for increased support at various regions of a foot. In some embodiments, upper 102 may include heel member 130 that is associated with heel portion 14. In some embodiments, heel member 130 may comprise a heel counter, which may help secure the foot in place within article 100 and add additional support.

Generally, heel member 130 may be associated with one or more components of article 100. For example, in some embodiments, heel member 130 may be associated with upper 102. In some cases, heel member 130 could be an external heel member that is disposed outside of upper 102 and generally visible on article 100. As one example, heel member 130 may be disposed on an outer surface of upper 102, such that heel member 130 cradles heel portion 14 of upper 102. In other cases, heel member 130 could be an internal heel member that is disposed within at least one layer of upper 102 and therefore not generally visible. In one embodiment, heel member 130 could be disposed inwardly of the innermost layer of upper 102, so that heel member 130 directly contacts a foot inserted into article 100. In another embodiment, heel member 130 could be integrated into a portion of upper 102, such that heel member 130 is disposed between two different layers of upper 102. In other embodiments, heel member 130 could be associated with a sole structure (not shown). In one embodiment, heel member 130 may be disposed on an outer surface of upper 102 and may be further configured to contact a heel portion of a sole structure (such as a midsole), especially at a bottom surface of heel member 130.

Generally, heel member 130 may be attached to one or more components of article 100 in any manner. In some embodiments, heel member 130 could be attached to a component (such as upper 102) using an adhesive. In other embodiments, heel member 130 could be stitched to a component (such as upper 102). Moreover, heel member 130 could be attached to one or more components of article 100 using any other methods for attaching heel members, such as heel counters, known in the art.

A heel member can include provisions for providing differential support on the lateral and medial sides of the heel. In some embodiments, for example, the geometry of a lateral portion and a medial portion of the heel member could be varied to provide different amounts and/or types of support to the lateral and medial sides of the foot. In some embodiments, the overall shape of a lateral portion and a medial portion may be substantially different, to provide different amounts and/or types of support on opposing sides of the heel. In some embodiments, one or more dimensions of a lateral portion and a medial portion could be substantially different, to provide different amounts and/or types of support on opposing sides of the heel. In some embodiments, the materials used for a lateral portion and a medial portion could be substantially different, to provide different amounts and/or types of support on opposing sides of the heel.

In order to provide different amounts and/or types of support on a lateral side and medial side of the heel, heel member 130 may be configured with different structural features along the lateral and medial portions of heel member 130. As discussed in further detail below, a lateral portion 150 of heel member 130 may have a shape that differs substantially from the shape of a medial portion 170.

Figure 4:
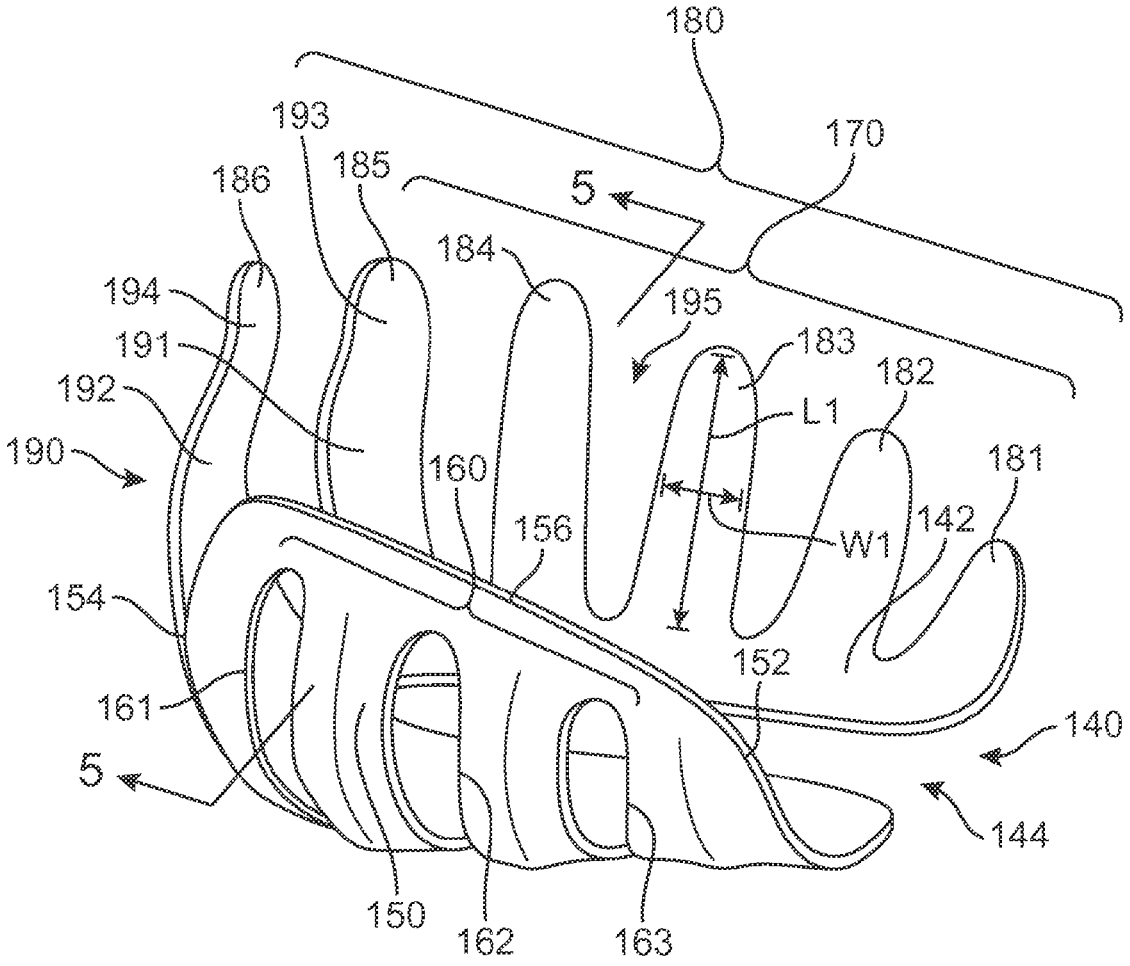
FIG. 4 is a schematic isometric view of an embodiment of a heel member for an article of footwear.

FIG. 4 illustrates a schematic isometric view of heel member 130 in isolation from the other components of article 100. Referring now to FIGS. 1 through 4, the general structure of heel member 130 may be characterized by various different portions including a base portion 140, a lateral portion 150 and a medial portion 170. Base portion 140 may comprise the bottom, or base, of heel member 130. In some cases, base portion 140 further comprises a peripheral portion 142 and a central gap 144 that extends through the center of base portion 140. This arrangement of central gap 144 surrounded by peripheral portion 142 may provide a lightweight base from which various other portions of base portion 140 can extend in order to support the sides and rear of a heel.

As most clearly seen in FIGS. 1 and 4, lateral portion 150 comprises a side-wall like portion that extends outwardly from the lateral side of peripheral portion 142 of base portion 140. In some embodiments, the general structure of lateral portion 150 may be characterized by a forward edge 152, a rearward edge 154 and a top edge 156. In some embodiments, forward edge 152, rearward edge 154 and top edge 156 may all be continuous around the periphery of lateral portion 150.

In some embodiments, the geometry of lateral portion 150 could be modified. For example, in some cases, top edge 156 may be substantially straight. In other cases, however, top edge 156 could be contoured or curved in any manner. Moreover, while the current embodiment illustrates a generally sloped configuration for lateral portion 150 in which the height of lateral portion 150 decreases from rearward edge 154 to forward edge 152, in other embodiments the height of lateral portion 150 may be approximately constant.

In some embodiments, lateral portion 150 includes provisions for reducing weight as well as for tuning the rigidity of lateral portion 150. In some embodiments, lateral portion 150 may be configured with plurality of windows 160. Plurality of windows 160, which further comprises first window 161, second window 162 and third window 163, may be window-like openings or slots in lateral portion 150. Although the current embodiment illustrates three windows, other embodiments could include any other number of windows including one, two, four and/or more than four windows. In some embodiments, plurality of windows 160 may have an approximately rectangular shape, though other embodiments could utilize any other geometry for one or more windows. The size and approximate geometry of each window could be varied according to factors including weight constraints, rigidity considerations, aesthetic considerations as well as possibly other factors.

As most clearly seen in FIGS. 2 through 4, medial portion 170 may have a substantially different geometry from lateral portion 150. In some embodiments, heel member 130 may include plurality of elongated portions 180, some of which comprise medial portion 170. In some cases, plurality of elongated portions 180, or simply elongated portions 180, may comprise finger-like projections that extend away (and generally upwardly or vertically) from peripheral portion 142 of base portion 140. In one embodiment, elongated portions 180 further include first elongated portion 181, second elongated portion 182, third elongated portion 183, fourth elongated portion 184, fifth elongated portion 185 and sixth elongated portion 186, which are separated from one another by plurality of gaps 195. Of these elongated portions 180, first elongated portion 181, second elongated portion 182, third elongated portion 183, fourth elongated portion 184 and fifth elongated portion 185 may comprise medial portion 170, while sixth elongated portion 186 may be associated with a rearward side 190 of heel member 130.

Although the current embodiment includes six elongated portions, including five that make up medial side 170, other embodiments could include any other number of elongated portions. For example, other embodiments could include one, two, three, four, five, six, seven or more than seven elongated portions. Moreover, medial side 170 could comprise any number of elongated portions in other embodiments.

The geometry of one or more elongated portions could vary in different embodiments. In some embodiments, as described above, elongated portions may be configured as finger-like projections. In some cases, elongated portions may have lengths that are substantially longer than their corresponding widths. As one example, third elongated portion 183 has a length L1 that is substantially longer than a width W1 of third elongated portion 183. Moreover, in some cases, the thickness of each elongated portion may be substantially less than both the corresponding lengths and widths.

In some embodiments, some of elongated portions 180 could comprise portions of varying shape and/or curvature. For example, as seen most clearly in FIG. 4, fifth elongated portion 185 and sixth elongated portion 186 may comprise first lower portion 191 and second lower portion 192 as well as first upper portion 193 and second upper portion 194. In some cases, first upper portion 193 and second upper portion 194 may be characterized by curvatures that are substantially different from the curvatures of first lower portion 191 and second lower portion 192. In particular, in some embodiments, the concave curvature of fifth elongated portion 185 and sixth elongated portion 186 at first lower portions 191 and second lower portion 192 (when viewed from the front of heel member 130) gradually changes to a convex curvature at first upper portion 193 and second upper portion 194. The geometric arrangement of some of the elongated portions helps heel member 130 to better grasp or wrap against the medial and rear sides of the foot.

In addition to varying shapes and structural features, some embodiments may include lateral and medial portions that differ in one or more dimensions. For example, in some embodiments, lateral portion 150 may be substantially shorter than medial portion 170, which may increase the stiffness of lateral portion 150 relative to medial portion 170. Although the following discussion describes an embodiment where the heights of lateral portion 150 and medial portion 170 may be substantially different, in other embodiments the heights of lateral portion 150 and medial portion 170 could be substantially equal. Moreover, in still other embodiments, lateral portion 150 and medial portion 170 could vary with respect to other dimensions including, for example, width and/or thickness.

Figure 5:
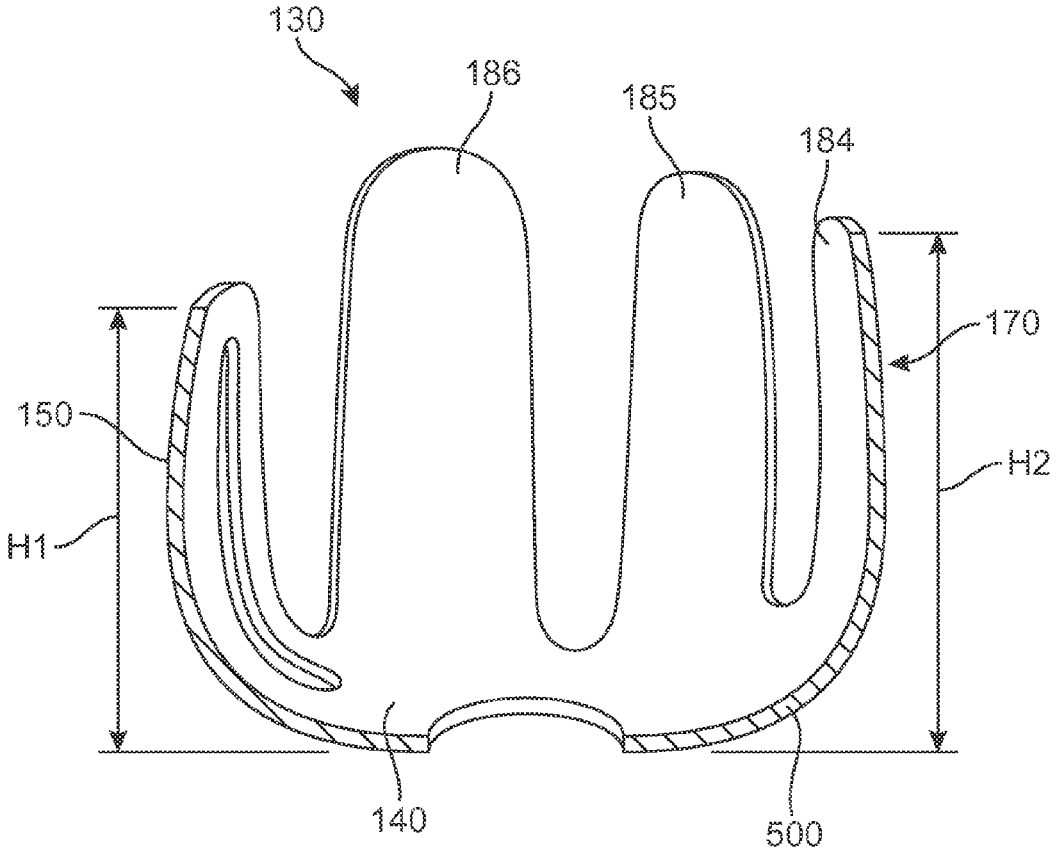
FIG. 5 is a schematic cross sectional view of an embodiment of a heel member for an article of footwear.

FIG. 5 illustrates a schematic cross sectional view of heel member 130, for purposes of indicating differences in the height of lateral portion 150 and medial portion 170. Referring to FIGS. 4 and 5, the respective heights of lateral portion 150 and medial portion 170 may be variable. Therefore, lateral portion 150 and medial portion 170 may be associated with a characteristic height, which is a height that may be used to characterize the whole of lateral portion 150 and/or medial portion 170. In some cases, the characteristic height could be an average height.

In general, medial portion 170 may be substantially taller (or higher relative to base portion 140) than lateral portion 150, at least across a majority of the length of medial portion 170 and lateral portion 150. As seen in FIG. 5, the heights of fourth projecting portion 184 and lateral portion 150 may be compared at the same longitudinal position 500. At position 500, lateral portion 150 has a height H1 and fourth projecting portion 184 has a height H2. In this case, height H2 is seen to be substantially greater than height H1. Although the height of medial portion 170 and lateral portion 150 may vary from height H2 and height H1, respectively, this difference in height is intended to be representative of the fact that medial portion 170 is taller (or higher) than lateral portion 150 along a majority of the longitudinal length of heel member 130. In some cases, the height of two or more projecting portions could be greater than the height of lateral portion 150. Moreover, any average height of medial portion 170 may be substantially greater than any average height of lateral portion 150.

In different embodiments, the material composition of heel member 130 could vary. Some examples of different materials that may be used include, but are not limited to: plastics (including polyurethane plastics and thermoplastic polyurethane plastics), foam materials, metallic materials, composite materials (such as carbon-fiber composite materials, glass-fiber composite materials and other composite materials) as well as any other materials known in the art for use in making heel members, heel counters, heel cups or similar structures. Some embodiments may comprise a heel member that is substantially monolithic, so that all portions of the heel member have a substantially similar material composition. In other embodiments, however, some portions of a heel member could be made of different materials from other portions of the heel member. As one possible example, some embodiments can use different materials for constructing a medial portion and a lateral portion of the heel member. Such a variation in materials could provide different material characteristics for the different portions and could be used, for example, to modify the rigidity characteristics of the lateral portion relative to the medial portion (or vice versa). The type of materials used for a heel member may be selected according various factors including, but not limited to, desired weight, desired rigidity, desired durability, desired abrasion resistance, desired resiliency, molding or other manufacturing considerations as well as possibly other factors.

The various features of a heel member may be selected to achieve a heel member with a relatively low overall weight. For example, the embodiments described here include a heel member 130 with various weight reducing features including, for example, central gap 144 and plurality of windows 160, which all act to reduce the total material volume of heel member 130. Additionally, the lower height of lateral portion 150 as well as plurality of gaps 195 may also minimize the volume of material used in heel member 130. Moreover, the structural features of heel member 130 are designed to impart added strength, support and controlled flexibility while still maintaining an ultralightweight heel member that can be incorporated into an article of footwear with a minimal addition of weight to the article.

In some embodiments, such as the embodiment shown in the figures, heel member 130 may comprise an integrally formed member such that lateral portion 150 and medial portion 170 are both integral with base portion 140. In other embodiments, heel member 130 may comprise one or more separated, or separable, portions. For example, in another embodiment, lateral portion 150 and/or medial portion 170 could be separate portions from base portion 140. In such cases, lateral portion 150 and/or medial portion 170 could be separately attached to portions of upper 102. In still other embodiments, any two portions of a heel member could be separable from each other. The selection of integral portions or separable portions can be made according to factors including desired flexibility of the heel of the upper, manufacturing considerations as well as possibly other factors. For example, in some embodiments using separate portions may make it easier to form portions having different material compositions.

Figure 6:
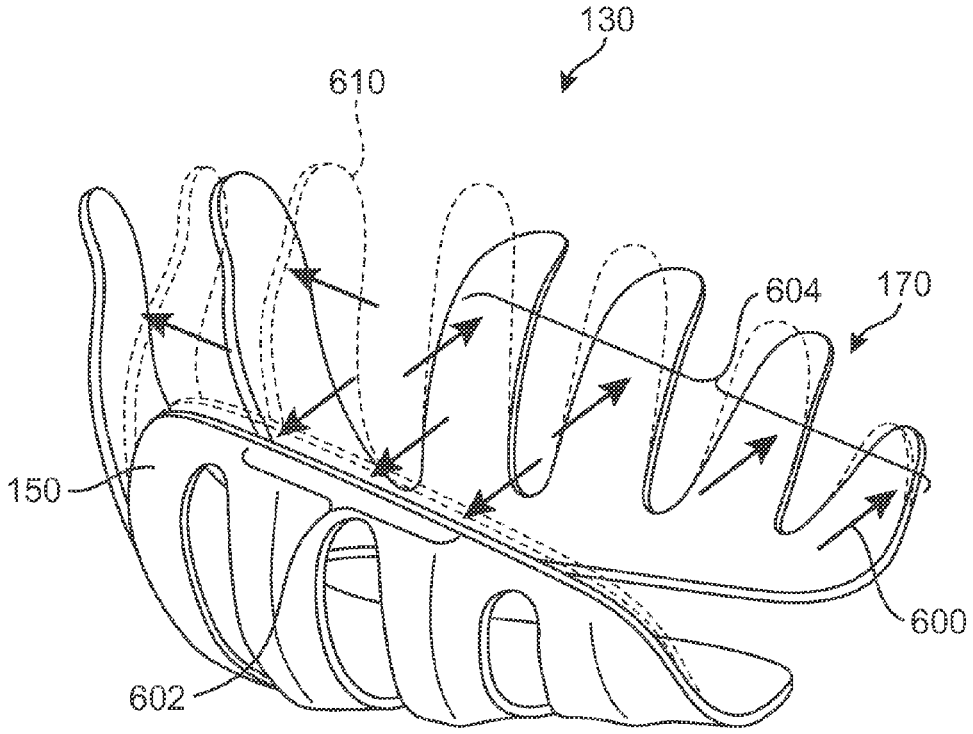
FIG. 6 is a schematic isometric view of an embodiment of a heel member, in which the lateral side portion and the medial side portion undergo bending forces.

FIG. 6 illustrates a schematic isometric view of an embodiment of heel member 130 reacting to various stresses. In order to best illustrate differences in the characteristics of different portions of heel member 130, heel member 130 is seen here to undergo outward forces 600, which may have approximately similar magnitudes, but which extend outwardly in various directions. In particular, outward forces 600 may include laterally directed forces 602 that apply an outward force against lateral portion 150. Outward forces 600 may also include medially directed forces 604 that apply an outward force against medial portion 170. Laterally directed forces 602 and medially directed forces 604 are generally intended to be representative of the types of forces that heel member 130 may undergo during typical use of a corresponding article of footwear, as a user may make various motions that apply forces to lateral portion 150 and/or medial portion 170.

In some embodiments, differences in geometry, height and/or material composition between lateral portion 150 and medial portion 170 may contribute to different characteristics, such as different degrees of flexibility and bending. For example, as discussed above laterally directed forces 602 and medially directed forces 604 may be similar in magnitude. However, the different bending characteristics of lateral portion 150 and medial portion 170 may result in substantially different amounts of bending. In particular, lateral portion 150 may undergo substantially less bending than medial portion 170, as lateral portion 150 may generally be shorter and may have a geometry that imparts a greater rigidity than medial portion 170. In contrast, the projecting portions comprising medial portion 170 may generally be taller and may have geometries that impart a greater degree of flexibility than lateral portion 150. Thus, as seen in FIG. 6, medial portion 170 may undergo substantially more bending or displacement from a default (or unstressed) position 610 when compared with lateral portion 150. In other words, medial portion 170 provides more give and gives more flexible or variable support. Lateral portion 150 may instead provide increased strength and limited bending or displacement from the default (or unstressed) position 610.

Figure 7:
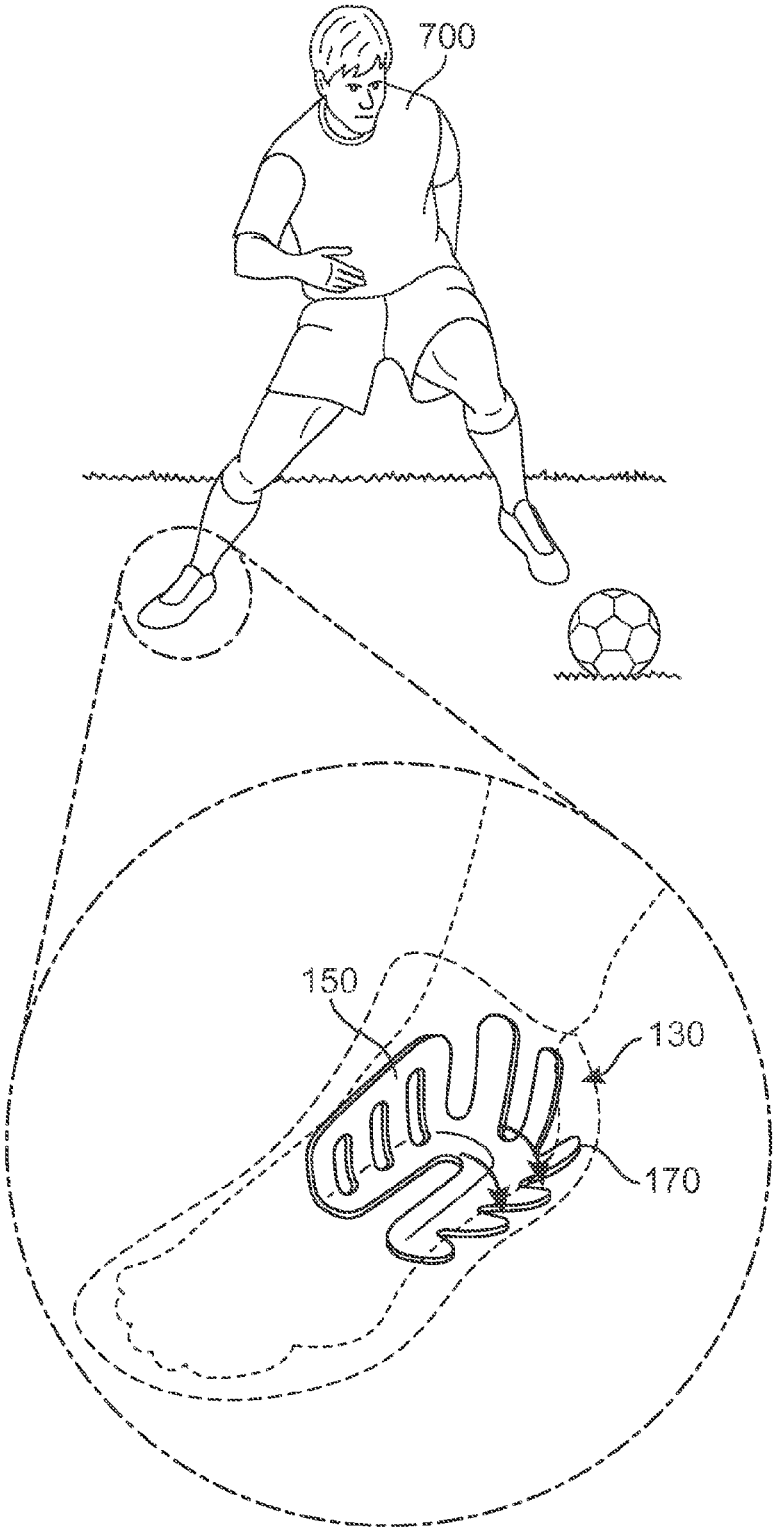
FIG. 7 is a schematic isometric view of an athlete cutting and an enlarged view of a heel member undergoing bending on the medial side.

Using this configuration, heel member 130 may present a relatively rigid lateral sidewall that helps reduce in-shoe slip during lateral motions, while increasing flexibility on a medial side to enhance turning and cutting. An example of this feature may be seen in FIG. 7, which shows a schematic view of an athlete 700 making a cutting motion while dribbling a ball. Referring to FIG. 7, lateral portion 150 remains relatively stiff to provide lateral support to the foot during planting. As athlete 700 makes a cutting motion, medial portion 170 is configured to bend and adapt to the medial motions of the heel.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A heel member, comprising:

a base portion, a medial portion extending from the base portion, a lateral portion extending from the base portion and a rearward portion extending from the base portion;

wherein the rearward portion is positioned substantially along a longitudinal central axis of the heel member;

the medial portion comprising a plurality of projecting portions;

the rearward portion comprising a second projecting portion; and wherein the medial portion is higher than the lateral portion along a majority of a length of the heel member.

2. The heel member according to claim 1, wherein an average height of the medial portion is greater than an average height of the lateral portion.

3. The heel member according to claim 1, wherein the plurality of projecting portions comprise finger-like projections.

4. The heel member according to claim 1, wherein a length of the projecting portions are substantially greater than a width of the projecting portions.

5. The heel member according to claim 1, wherein the medial portion is configured to be more flexible than the lateral portion.

6. The heel member according to claim 1, wherein the second projecting portion includes a finger-like projection disposed between the medial portion and the lateral portion along a peripheral portion of the base portion.

7. A heel member, comprising:

a base portion, a medial portion extending from the base portion and a lateral portion extending from the base portion;

wherein the medial portion is asymmetrical from the lateral portion;

the medial portion comprising a plurality of projecting portions;

the lateral portion including a continuous top edge that extends along the length of the lateral portion;

wherein only the lateral portion includes at least one window; and wherein the at least one window has an approximately elongated rectangular shape.

8. The heel member according to claim 7, wherein the lateral portion includes two or more windows.

9. The heel member according to claim 8, wherein each of the two or more windows has an approximately elongated rectangular shape.

10. The heel member according to claim 7, wherein the lateral portion is more rigid than the medial portion.

11. The heel member according to claim 7, wherein a height of at least two of the plurality of projecting portions measured with respect to the base portion is substantially greater than a height of the lateral portion measured with respect to the base portion.

12. The heel member according to claim 7, wherein the base portion includes a central gap.

13. The heel member according to claim 7, wherein the medial portion is configured to bend during a medial motion.

14. A heel member, comprising:

a base portion, a medial portion extending from the base portion and a lateral portion extending from the base portion;

the medial portion comprising a plurality of projecting portions;

wherein only the lateral portion includes a plurality of elongated rectangular windows; and wherein the lateral portion is substantially more rigid than the medial portion.

15. The heel member according to claim 14, wherein the medial portion comprises between two and four projecting portions.

16. The heel member according to claim 14, wherein a height of the plurality of projecting portions varies along a length of the medial portion.

17. The heel member according to claim 14, wherein the plurality of projecting portions are separated by a plurality of gaps.

18. The heel member according to claim 14, wherein a height of at least two of the plurality of projecting portions measured with respect to the base portion is substantially greater than a height of the lateral portion measured with respect to the base portion.

19. The heel member according to claim 14, wherein the lateral portion and the medial portion are made of the same material.

20. The heel member according to claim 14, wherein the geometry of the lateral portion may be characterized by a forward edge, a rearward edge and a top edge.

* * * * *